United States Patent [19]

Mardirossian

[11] 4,199,968

[45] Apr. 29, 1980

[54] BAND MAKING APPARATUS

[75] Inventor: John H. Mardirossian, Warwick, R.I.

[73] Assignee: Textron, Inc., Providence, R.I.

[21] Appl. No.: 959,994

[22] Filed: Nov. 13, 1978

[51] Int. Cl.[2] ..... B21C 37/12

[52] U.S. Cl. ..... 72/49; 72/139; 72/144

[58] Field of Search ..... 72/49, 50, 135, 137, 72/138, 139, 142, 144

[56] References Cited

U.S. PATENT DOCUMENTS

| | | | |
|---|---|---|---|
| 915,673 | 3/1909 | Heid | 72/144 |
| 1,562,645 | 11/1925 | Jones | 72/144 |
| 1,617,583 | 2/1927 | Fertress | 72/49 |
| 1,623,766 | 4/1927 | Way | 72/137 |
| 2,314,510 | 3/1943 | Odor | 72/144 |
| 2,439,893 | 4/1948 | Iden | 72/144 |
| 2,631,639 | 3/1953 | Palmer | 72/66 |
| 3,139,850 | 7/1964 | Wiegel | 72/135 |
| 4,046,176 | 9/1977 | LeGall | 140/92.1 |

FOREIGN PATENT DOCUMENTS

| | | | |
|---|---|---|---|
| 1156166 | 6/1969 | United Kingdom | 72/49 |
| 1313902 | 4/1973 | United Kingdom | 72/49 |

*Primary Examiner*—Lowell A. Larson
*Attorney, Agent, or Firm*—Edgar H. Kent

[57] ABSTRACT

Band making apparatus comprising a mandrel on which is wound wire of U-shaped cross-section with relatively inverted portions alternating longitudinally of the axis of the mandrel having a side edge interengaged in the channel of the other, has a guide for guiding the wire onto the mandrel provided with a guiding surface which engages the external surface of a side of the wire incoming to the mandrel, and the wire and mandrel are relatively rotated about the axis of the mandrel and reciprocated longitudinally of that axis at a controlled speed ratio such that the back pressure of previously wound turns maintains the incoming wire side against the guiding surface.

9 Claims, 4 Drawing Figures

BAND MAKING APPARATUS

BACKGROUND OF THE INVENTION

This invention relates to apparatus for winding metal wire into bands, such as watchbands. The wire is of channel, U-shaped cross-section formed to present alternately inverted "U"s longitudinally of the axis of the wind, such as the S or Z shaped cross-section wire employed in U.S. Pat. No. 3,893,319 and in the bands wound therefrom and flattened as disclosed therein. The invention is an improvement for certain purposes of the guide arrangement disclosed in said patent for guiding the wire as it is wound on a relatively axially reciprocating and rotating mandrel.

SUMMARY OF THE INVENTION

In the apparatus disclosed in the aforesaid patent, the S or Z shaped wire is guided onto a rotating mandrel by a guide roller which is reciprocated longitudinally of the axis of rotation of the mandrel and has a peripheral flange which fits snugly into the out-facing U-section of the composite wire and thus prevents relative movement of the wire in either transverse direction. This roller, and a counterbalancing roller which engages the mandrel opposite but spaced axially from the guide roller, are mutually biased toward the mandrel by an interconnecting spring arrangement.

With this arrangement, difficulties may be experienced in obtaining the requisite constant desired fitting of the guide roller flange into the out-facing channel of the wire. Particularly where the wire channels are of minute cross-section, the guide roller flange may have to be so thin as to cause it to distort undesirably, and engagement between the flange and the sides of the wire channel can cause grinding between the flange and the wire, the dust or flakes whereof may remain in the channel to undesirably contaminate the wound band or may cling to the flange and build up sufficiently to cause eventual malfunction.

It has now been discovered that these difficulties can be overcome by repositioning the guide roller flange so that it no longer enters the out-facing wire channel but engages instead the outer face of its adjacent side edge. With this change the roller no longer exerts control over lateral movement of the wire away from the roller flange, but it has been found that this deficiency can be adequately remedied by controlling the ratio of the relative reciprocation to the winding rate, so that the wire turn being wound is held against the guide roller flange by back pressure of previously wound wire turns. Usually, this ratio provides axial reciprocating movement of the guide relative to the mandrel per wire turn on the mandrel of between 85% and 100%, preferably about 95%, of the width of wire being wound. In this manner, the changed guide can be made to function adequately, and its flange no longer has the thickness limitation nor the fitting-grinding problems of the wire-channel-fitting flange.

In addition to the foregoing change in the guide roller of the aforesaid patent, it has been found desirable to reposition the guide and counterbalancing rollers so that the flange of the latter is opposite the area of contact between the guide roller flange and the wire, and the guide roller is above the mandrel, rather than below it as in the patent.

The remainder of the apparatus in which the above improvement is incorporated may be the same as disclosed in the aforesaid patent and such is contemplated in the ensuing more detailed description of a preferred embodiment, so that reference to said patent may be had to augment said description as to details of apparatus components which do not relate sufficiently to the present invention to warrant redisclosure herein.

BREIF DESCRIPTION OF THE DRAWINGS

Figure 2A:
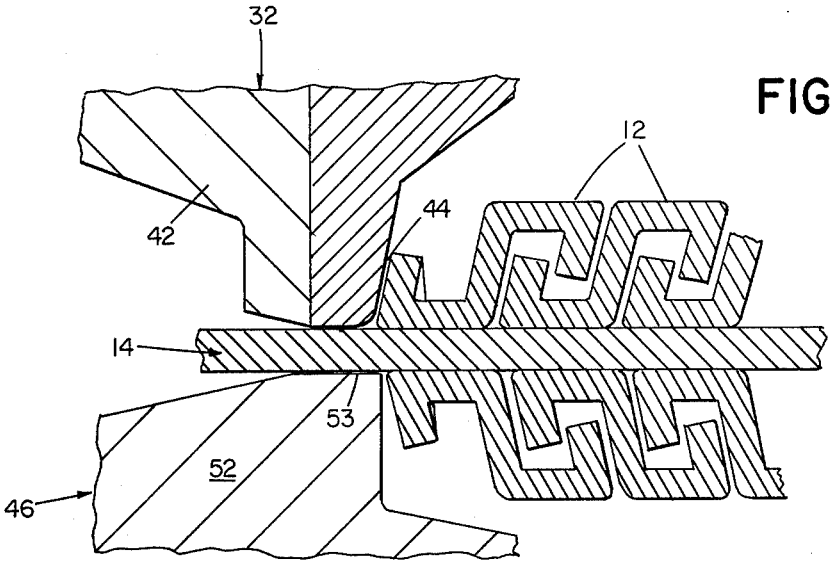
FIG. 2 is a view, partially in vertical section, partially in side elevation, of the portion of the apparatus embodying the guide and counterbalancing roller arrangement according to the invention.
Figure 2:
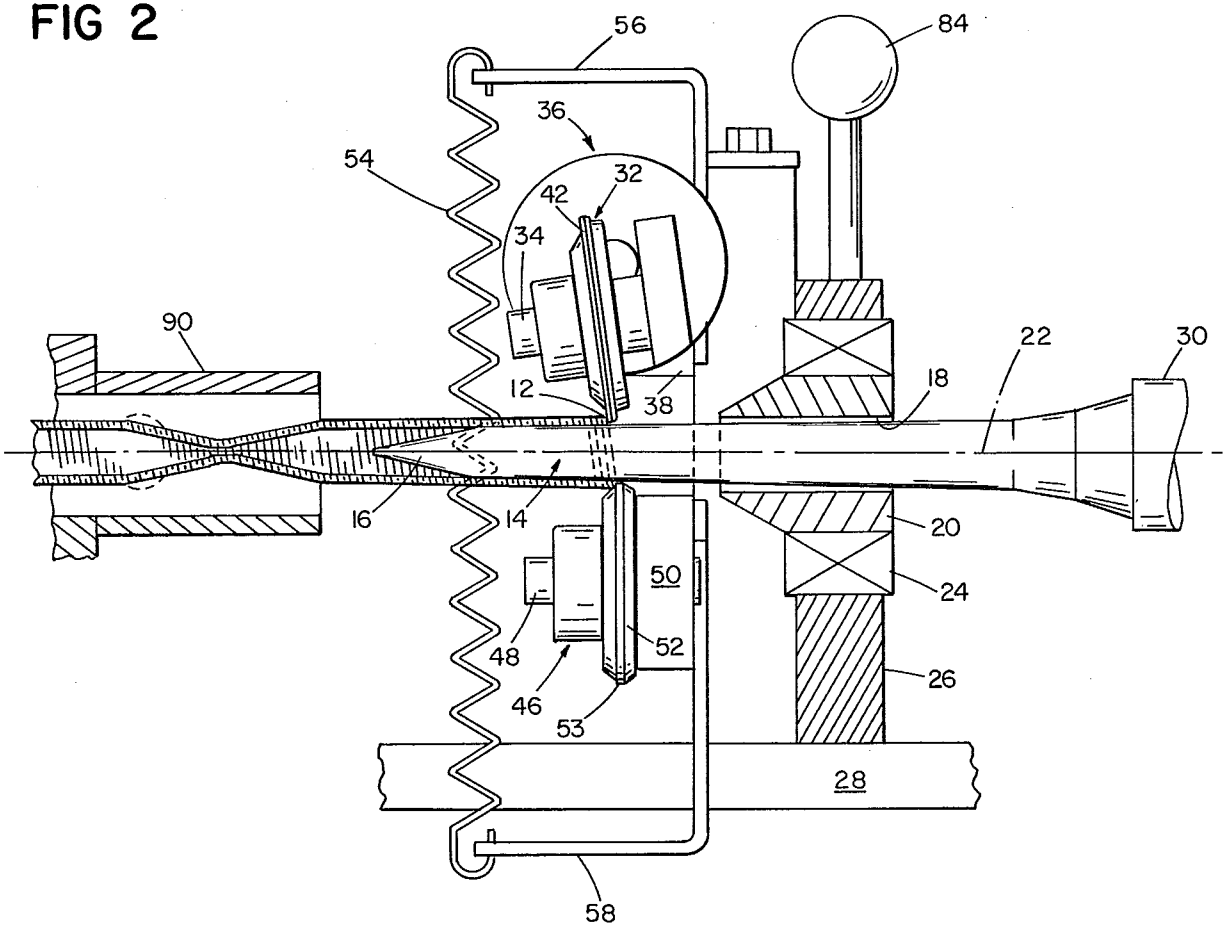

FIG. 2*a* is a cross-sectional enlargement of a fragment of FIG. 2; and

Figure 3:
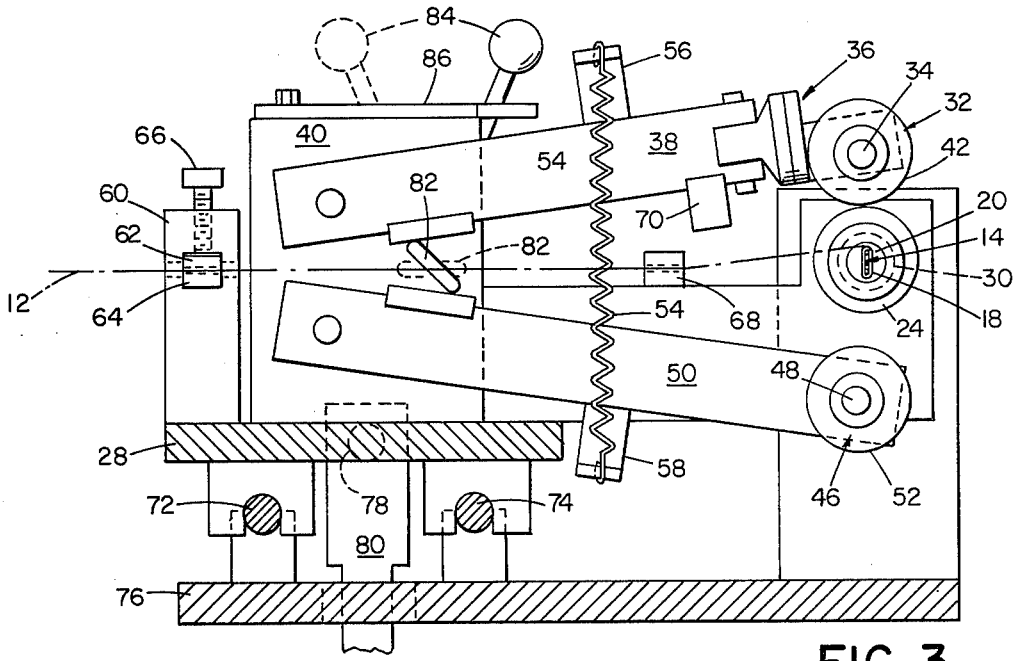

FIG. 3 is a side view, partially sectioned, of the roller supporting and wire guiding components for the apparatus shown in FIG. 2.

DESCRIPTION OF THE PREFERRED EMBODIMENT

As in aforesaid U.S. Pat. No. 3,893,319, the apparatus according to the present invention preferably utilizes a thin flat mandrel with rounded edges and a tapered tip, and is so shown. This forms the wire into a generally flat spiral wound tube which, by reason of reciprocation of the guide roller relative to the mandrel and its tapered tip, has a series of oppositely tapered portions joined at their narrow ends and separated by strips of uniform width (see FIG. 2). The tube is severed by automatic cutting mechanism at the mid-points of the tapered portions and of the uniform width portions to form a series of straps 10 (FIG. 1) with a tapered end and a wide end, which may be attached in pairs to a watch to form a watchband, the two parts being fastened together at the tapered ends by a suitable clasp.

Figure 1:
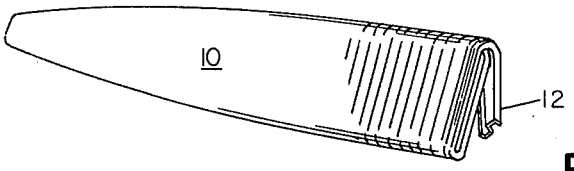
FIG. 1 is a perspective view of a band segment wound with apparatus according to this invention and cut-off but not flattened.

As shown in FIG. 1, the wire 12 is formed to present a series of U-shaped sections alternately inverted longitudinally of the wind axis, and may be of generally S or Z shape, the Z shape being indicated in FIG. 2*a*. The winding interlocks an edge of each inverted U section into the adjacent non-inverted section, so that the strap is non-extensible but is flexible in the direction normal to its large surfaces. Both the flexibility and appearance of the bands as wound and shown in FIG. 1 are enhanced by further compression-flattening thereof in the direction normal to their large surfaces.

Referring now to FIG. 2, the mandrel, designated generally 14, is in the form of a thin flat blade with rounded side edges and a tapered tip 16 at one end. The other end of the mandrel extends with a sliding fit through slot 18 of guide block 20 which is mounted for rotation about the axis of rotation 22 of the mandrel in roller bearing 24 in support arm 26 fixed to a support 28. Beyond support arm 26, the mandrel is integrally, coaxially joined to a drive shaft 30, which is rotated about axis 22 and reciprocated longitudinally thereof by drive connections not shown herein but shown in the aforesaid patent and more fully hereinafter described.

The wire is guided onto the rotating, reciprocating mandrel by guide roller 32 to which the wire is drawn by the winding from a suitable source (not shown, which may be a freely rotatable spool). Roller 32 is freely rotatable on a shaft 34 journaled in adjustable universal head 36 mounted just above mandrel 14 at one end of an arm 38 which is pivoted at its opposite end to a support bracket 40 on support 28 (FIG. 3). In accordance with the present invention, roller 32 has a peripheral flange 42 which extends into engagement with the mandrel and has a smooth face 44 arranged to contact the outside face of the side of the near channel of the wire as it is wound (see FIG. 2*a*). Surface 44 is ground at a slight angle generally conforming to the slope of the wire side, and head 36 is adjustable to allow roller 32 to be tilted slightly (preferably about 1½°) toward the wire, so that surface 44 will engage fully the wire side. (With a straight-sided channel wire, surface 44 is approximately at a right angle to the mandrel axis). Roller 32 is shown as formed of two parts joined together vertically at the center, but it may be a single part.

On the opposite, underside of the mandrel from roller 32, there is provided counterbalancing roller 46 which is freely rotatable on shaft 48 journaled at one end of arm 50 the opposite end of which is pivoted to bracket 40 (FIG. 3). Roller 46 has a flange 52 with a peripheral surface 53 which engages the mandrel opposite the engagement thereof by flange 42 of roller 32 and the adjacent wire edge to balance the forces exerted by flange 42 and prevent whipping of the mandrel. A spring 54 extends between brackets 56 and 58 on arms 38 and 50 to bias the arms toward each other (with some 15 to 18 pounds of force), thereby holding the roller flanges against the mandrel to follow its contour as they spread to accommodate the widest edge portion of the mandrel and contrast as they return to the thin flat portion.

As shown in FIG. 3, a wire tensioning device is mounted on an arm 60 fixed to support 28 and has opposed nylon blocks 62, 64, shaped to fit into the channels of the wire 12, which is drawn between them from the source previously mentioned. An adjustable thum screw 66 controls the pressure exerted on the wire and its tensioning. From the tensioning device, the wire 12 passes freely between arms 38 and 50 through a guide block 68 secured to an extension of bracket 40, and providing a cut-out portion in the shape of the wire to maintain it in proper position as it passes therethrough past outboard guide 70 on arm 38 onto the mandrel. Support 28 for bracket 40 and arm 60 is mounted to slide on rods 72, 74 in a direction parallel to the winding axis of the mandrel for reciprocation of the wire guiding mechanisms longitudinally of that axis, rods 72, 74 extending between mounts on a base 76. To effect such reciprocation, a rod 78 fixed to support 28 has a bracket 80 fixed thereto which is connected by linkage to suitable reciprocation mechanism (not shown), which may desirably be the heart-shaped cam with follower linked to bracket 80 and driven from a variable speed motor, as disclosed in detail in the aforesaid patent.

Mandrel shaft 30 is driven at a precisely controlled rotation rate by suitable non-slip drive connections to said variable speed motor (not shown). This rotation rate is also precisely related to the rate of reciprocation of support 28 and the wire guide mechanism carried thereby through rod 78 and bracket 80. Such relation may desirably be effected by mechanism for the purpose not shown herein but disclosed in the aforesaid patent, namely, drive connections from the variable speed motor to the cam controlling the reciprocation rate that include a variable speed reducer and a reductor, the gear ratio of the reducer being variable to produce the desired ratio of mandrel rotation to guide mechanism reciprocation. This ratio is not only controlled to produce the desired interlock of wire turns as disclosed in the aforesaid patent but also, to enable satisfactory operation of the different wire guide roller 32 provided by the present invention, is controlled so that back pressure of pre-wound coils continually forces the incoming wire 12 against surface 44 of roller 32. As previously mentioned, this ratio, so controlled, should usually be such that the reciprocation per turn of wire on the mandrel is between 80% and 100% of the width of the two U-shaped sections of the wire, preferably about 95% thereof.

In order to facilitate threading of the wire 12 into the machine on start-up, a block 82 of rectangular cross-section is pivotally mounted on bracket 40 (FIG. 3) between arms 38 and 50 near their pivoted ends. A lever 84 is connected to block 82 for turning the block between a horizontal position (shown in dashed lines) out of contact with the arms, and a more nearly vertical position (shown in solid lines) in which the block forces the arms apart to allow the wire threading. Safety latch 86 on bracket 40 is provided to lock lever 82 in the open position.

In the operation of the apparatus, with arms 38 and 50 held apart by block 82, wire 12 is threaded between tension block parts 62 and 64 and through guide 68 and is wrapped around the mandrel, interlocking the edge of the mandrel-facing channel adjacent the free end of the wire in the oppositely facing channel of the first turn. A hand wheel (not shown) on mandrel shaft 30 is provided to aid this initial wrapping. Lever 84 is moved to close the arms bringing the flanges of rollers 32 and 46 into engagement with the mandrel. With manual pressure exerted on the wire to hold its incoming edge against face 44 of the flange of roller 32, the mandrel is hand-rotated to wind a few turns of wire 12 on the mandrel, making sure that successive turns interlock properly.

The variable speed motor is then turned on to rotate the mandrel and reciprocate the wire guide mechanism in preadjusted ratio through operating connections previously described, the ratio being such as to maintain the incoming wire against guide flange face 44 as above set forth. Considering the traverse from right to left in FIG. 2, as the new turns of wire on the mandrel build up they and the traverse movement force the previous turns to move axially along the mandrel and eventually off over its tip. As the guide mechanism approaches the mandrel tip, the wire turns reduce progressively in diameter. Arms 38 and 50 automatically open and close under the control of spring 54 in response to changing thickness of the mandrel between them due to the flat shape of its shank and the taper of its tip, always holding the flanges of rollers 32 and 46 against the mandrel.

When the traverse reverses with the winding near the end of the blade tip, the successive turns increase in diameter until the reduced tip of the mandrel is passed, thus producing the second of the two wound tapered sections joined end to end shown in FIG. 2. The wire, however, remains on the mandrel during this direction of traverse until the desired half length of uniform dimension tube portion has been wound and the next reversal occurs, after which the turns formed in the previous traverse will be pushed off as the new turns are formed and movement proceeds again in the right-to-left traverse until the next reversal, and so on. Always, back pressure of previous turns maintains the incoming wire edge against roller flange face 44.

As the wound wire tube is forced off the mandrel, it enters receiving tube 90, which desirably conducts it to automatic cutting mechanism (not shown) such as that disclosed in the aforesaid patent, for automatically severing the wound wire tube into segments of the desired length. This may extend from the mid point of the uniformly dimensioned portions to the mid point between the oppositely tapered portions as discussed above, or from midpoint to midpoint of successive oppositely tapered portions as another example. These segments are then flattened by compression, as previously mentioned. Mandrels of other cross-sectional shape than shown may be used, although the thin, flat shape shown is desirable as pre-forming the wound wire tube close to its ultimate flattened shape and dimensions.

I claim:

1. In band making apparatus which comprises a mandrel having an axis, means for supplying to said mandrel wire of U-shaped cross-section having relatively inverted portions alternating longitudinally of said axis, a guide for guiding said wire onto said mandrel, and variable speed mechanism for relatively rotating said mandrel and said guide about said axis and for relatively reciprocating said mandrel and said guide longitudinally of said axis in a controlled speed ratio such that the wire is wound on said mandrel with a side edge of alternately inverted portions interengaged in the channel of the other;

the improvement wherein said guide has a guide surface arranged to engage the external surface of the side edge of the wire incoming to the mandrel, bias means are provided for urging said guide toward the axis of the mandrel, and said ratio is such that the back pressure of previously wound turns of wire on said mandrel maintains said surface of said incoming wire against said guide surface.

2. Apparatus according to claim 1 wherein said ratio is between 80% and 100% of the width of the wire incoming to said mandrel.

3. Apparatus according to claim 2 wherein said ratio is about 95% of said width.

4. Apparatus according to claim 1, 2 or 3 wherein said guide comprises a roller having a flange providing said guide surface.

5. Apparatus according to claim 4 wherein said biasing means urges said guide roller flange against the mandrel and a counterbalancing roller is provided having a flange biased into engagement with the mandrel opposite the area of engagement between said guide surface and the wire.

6. Apparatus according to claim 5 wherein said bias means is connected to urge said guide and counterbalancing rollers together.

7. Apparatus according to claim 5 wherein said rollers are freely rotatable.

8. Apparatus according to claim 1 wherein said mandrel is tapered toward a free end so that said reciprocation causes a wound tube with reversely tapered portions joined at their smaller ends to be fed off the tube.

9. Apparatus according to claim 8 wherein said mandrel is rotated and said guide is reciprocated.

* * * * *